US008138678B2

(12) United States Patent
Ishida et al.

(10) Patent No.: US 8,138,678 B2
(45) Date of Patent: Mar. 20, 2012

(54) CHARGED PARTICLE BEAM DECELERATING DEVICE AND METHOD, AND X-RAY GENERATING APPARATUS USING THE SAME

(75) Inventors: Daisuke Ishida, Tokyo (JP); Hiroyuki Nose, Tokyo (JP); Namio Kaneko, Tokyo (JP); Yasuo Sakai, Tokyo (JP); Masashi Yamamoto, Tokyo (JP); Mitsuru Uesaka, Tokyo (JP); Katsuhiro Dobashi, Tokyo (JP); Fumito Sakamoto, Tokyo (JP)

(73) Assignees: IHI Corporation, Tokyo (JP); The University of Tokyo, Tokyo (JP)

( * ) Notice: Subject to any disclaimer, the term of this patent is extended or adjusted under 35 U.S.C. 154(b) by 379 days.

(21) Appl. No.: 12/528,386

(22) PCT Filed: Mar. 18, 2008

(86) PCT No.: PCT/JP2008/054931

§ 371 (c)(1),
(2), (4) Date: Aug. 24, 2009

(87) PCT Pub. No.: WO2008/120571

PCT Pub. Date: Oct. 9, 2008

(65) Prior Publication Data

US 2010/0080356 A1 Apr. 1, 2010

(30) Foreign Application Priority Data

Mar. 23, 2007 (JP) ..... 077621/2007

(51) Int. Cl.

| | |
|---|---|
| ***H01J 35/00*** | (2006.01) |
| ***H01J 49/20*** | (2006.01) |
| ***H01J 49/44*** | (2006.01) |
| ***H05H 7/08*** | (2006.01) |

(52) U.S. Cl. ..... 315/111.61; 315/507; 315/500; 313/360.1; 313/361.1; 313/363.1; 378/119; 378/145

(58) Field of Classification Search ..... 315/500, 315/507, 111.61; 313/360.1, 383.1, 361.1; 378/119, 145

See application file for complete search history.

(56) References Cited

U.S. PATENT DOCUMENTS 4,780,682 A 10/1988 Politzer (Continued)

FOREIGN PATENT DOCUMENTS

JP 02-135700 5/1990

(Continued)

OTHER PUBLICATIONS

G.M. Kazakevitch et al., "Magnetron Driven Classical Microtron As An Injector For a Wide Band Tunable Compact Far Infrared Free Electron Laser," Proceedings of the 2001 Particle Accelerator Conference, Chicago, Jun. 22, 2011, pp. 2739-2741, XP002623248.

(Continued)

*Primary Examiner* — Nikita Wells
(74) *Attorney, Agent, or Firm* — Griffin & Szipl, P.C.

(57) ABSTRACT

A charged particle beam decelerating device includes a high-frequency cavity 34 provided on an orbit of a charged particle beam 1, and a phase synchronizing device 40 for synchronizing the charged particle beam 1 in the high-frequency cavity with a phase of a high-frequency electric field 4. By moving the high-frequency cavity 34 or changing an orbit length of the charged particle beam 1, the charged particle beam in the high-frequency cavity is synchronized with a phase of the high-frequency electric field 4.

17 Claims, 6 Drawing Sheets

U.S. PATENT DOCUMENTS

| | | | | | |
|---|---|---|---|---|---|
| 5,168,241 | A | * | 12/1992 | Hirota et al. | 315/500 |
| 5,216,377 | A | * | 6/1993 | Nakata et al. | 315/501 |
| 5,363,008 | A | * | 11/1994 | Hiramoto et al. | 313/62 |
| 5,600,213 | A | * | 2/1997 | Hiramoto et al. | 315/507 |
| 5,789,875 | A | | 8/1998 | Hiramoto et al. | |

FOREIGN PATENT DOCUMENTS

| | | | |
|---|---|---|---|
| JP | 08-172000 | | 7/1996 |
| JP | 11-045800 | | 2/1999 |
| JP | 11-067498 | | 3/1999 |
| JP | 11-260598 | | 9/1999 |
| JP | 2000-200699 | | 7/2000 |
| JP | 2000-323299 | | 11/2000 |
| JP | 2001-52896 | A | 2/2001 |
| JP | 2002-141200 | | 5/2002 |
| JP | 2002-280200 | | 9/2002 |
| JP | 2003-272899 | A | 9/2003 |
| JP | 2005-85473 | A | 3/2005 |
| JP | 2007-27001 | A | 2/2007 |

OTHER PUBLICATIONS

Atsushi Fukasawa et al., "A Tunable Monochromatic Hard X-ray CT composed of an X-band Linear accelerator and a Q-Switched Laser," Nuclear Instruments and Methods in Physics Research, Nov. 9, 2005, pp. 921-925, XP002622996.

N.H. Quyet et al., "Compact X-Band (11.424 GHZ) Linac For Cancer Therapy," Proceedings of EPAC 2004, Lucerne, Switzerland, Sep. 1, 2004, XP002622997.

Supplementary European Search Report issued in European Application No. 08 72 2325.1, completed Feb. 18, 2011, mailed Mar. 4, 2011.

Office Action issued in Japanese Patent Application No. 2007-077621, dated May 21, 2010 with its english translation.

Hariyuki Ogino, et al., "The compact hard x-ray generator with deceleration system," Atomic Energy Society of Japan 2004 Nen Haru no Nenkai Yoshishu, Mar. 11, 2004, Dai 42 Kai separate vol. 1, p. 202.

Atsushi Fukasawa et al., "Design Study on a Low-Noise-Radiation Accelerator for Compact Compton Scattering Hard X-Ray Source," Atomic Energy Society of Japan 2005 Nen Haru no Nenkai Yoshishu, Mar. 11, 2005, Dai 43 Kai separate vol. 1, p. 154.

Katuhiro Dobashi et al., "Development of Small-Sized Hard X-Ray Source Using X-Band linac", the 27th Linear Accelerator Technology and Research Meeting in Japan, 2002.

International Search Report issued in corresponding application No. PCT/JP2008/054931, completed Jun. 10, 2008 and mailed Jun. 17, 2008.

* cited by examiner

CHARGED PARTICLE BEAM DECELERATING DEVICE AND METHOD, AND X-RAY GENERATING APPARATUS USING THE SAME

This is a National Phase Application in the United States of International Patent Application No. PCT/JP2008/054931 filed Mar. 18, 2008, which claims priority on Japanese Patent Application No. 077621/2007, filed Mar. 23, 2007. The entire disclosures of the above patent applications are hereby incorporated by reference.

TECHNICAL FIELD OF THE INVENTION

The present invention relates to a charged particle beam decelerating device and method for decelerating energy of a charged particle beam, and an X-ray generating apparatus using the device and method.

DESCRIPTION OF THE RELATED ART

In the invention, a charged particle beam means an electron beam, an ion beam and a positron beam.

It is known that a quasi-monochromatic X-ray resulting from Compton scattering is obtained by collision of an electron beam with a laser beam (for example, Non-Patent Document 1).

In a "small-sized X-ray generating apparatus" of Non-Patent Document 1, as shown in FIG. 1, an electron beam 62 accelerated by a small-sized accelerator 61 (X-band accelerating tube) is allowed to collide with a pulse laser beam 63 to generate an X-ray 64. The electron beam 62 generated by an RF (Radio Frequency) electron gun 65 (thermal RF gun) is accelerated by the X-band accelerating tube 61, and collides with the pulse laser beam 63. The hard X-ray 64 having a time width of 10 ns is generated by Compton scattering.

This device is miniaturized by using an X-band (11.424 GHz) as an RF, the X-band corresponding to a frequency four times as high as that of an S-band (2.856 GHz) for general use in a linear accelerator. For example, it is predicted that the hard X-ray having an X-ray intensity (number of photons) of about $1\times10^9$ photons/s and a pulse width of about 10 ps is generated.

Further, for example, Patent Documents 1 and 2 have already been disclosed as techniques related to the invention.

An object of an "electron beam accelerating device" of Patent Document 1 is to suppress energy variation during rise of a beam pulse. As shown in FIG. 2, the device provided with a stabilizing high-frequency oscillator 71, an accelerating large-output pulse high-frequency source 81 and an accelerating tube 82 in this order has high-frequency dividing means 73 for dividing high-frequency waves, phase modulators (74 and 75) for adjusting phases of the divided high-frequency waves, means 76 for combining the high-frequency waves, the accelerating large-output pulse high-frequency source 81 for receiving the combined high-frequency wave from the means 76, a pulse electron source 84 for outputting electron beams to the accelerating tube 82, and means 77 for instructing the phase modulators (74 and 75) to modulate the phases of the divided high-frequency waves so as to give amplitude modulation to the portion in which the rise of an accelerating high-frequency pulse occurs, thereby correcting accelerating energy variation by a beam loading effect generated in the portion in which the rise of an electron beam pulse occurs.

An object of an "electron beam device" of Patent Document 2 is to adjust a synchronous phase of an electron beam and a high-frequency acceleration cavity 91. As shown in FIG. 3, for obtaining high energy, the electron beam device repeats more than once a process of guiding an electron emitted from an electron gun to the high-frequency acceleration cavity 91 to be accelerated in the high-frequency acceleration cavity, deflecting a beam orbit by 180 degrees by a deflecting electromagnet 92 provided outside the high-frequency acceleration cavity 91, and emitting the accelerated electron into the high-frequency acceleration cavity again to be accelerated. In this the electron beam device, the deflecting electromagnet 92 is provided so that a distance between the high-frequency acceleration cavity 91 and the deflecting electromagnet can be changed to adjust a synchronous phase of an electron beam.

[Non-Patent Document 1] Katuhiro Dobashi et al., "Development of Small-Sized Hard X-Ray Source Using X-Band linac", the 27th Linear Accelerator Technology and Research Meeting in Japan, 2002

[Patent document 1] Japanese Patent Application Laid-Open No. 11-45800, "Electron Beam Accelerating Device"

[Patent Document 2] Japanese Patent Application Laid-Open No. 2002-141200, "Electron Beam Device"

As described above, a system for generating a monochromatic hard X-ray by using Compton scattering caused by collision of an electron beam with a laser beam has been developed. However, in this system, when the electron beam collided with the laser beam collides with a beam dump or the like finally, an intense X-ray generated by the collision may cause problems. Accordingly, the same system using a high-energy electron beam requires large-scale shielding, and it is difficult to achieve miniaturization of the system and cost reduction.

For example, when an accelerated electron beam has high energy of 10 MeV or more and when the electron beam collides with a beam dump or the like finally, intense radiation (X-ray, neutron and γ-ray) is generated by the collision. Accordingly, in order to prevent the radiation from being generated, it is necessary to decelerate the energy before the collision up to less than 10 MeV.

Even when decelerated up to less than 10 MeV, the energy before the collision is regarded as a radiation source under laws of Japan (atomic energy basic laws and laws concerning the prevention from radiation hazards due to radioisotopes and others) if it is not decelerated up to less than 1 MeV. For this reason, large-scale shielding (or strict radiation safety management) is required. Accordingly, in order to achieve miniaturization of the system and cost reduction, it is necessary to decelerate the electron beam before the collision to the above level.

Among charged particle beams, an ion beam is regarded as a radiation source without classification by energy, and thus it is subject to control of the atomic energy basic laws and laws concerning the prevention from radiation hazards due to radioisotopes and others.

A dedicated high-frequency cavity charged with a high-frequency wave is used to accelerate an electron beam in a linear accelerator. Accordingly, the same high-frequency cavity can be used to decelerate energy of the electron beam in principle. However, in order to decelerate the electron beam in the high-frequency cavity, it is necessary to precisely adjust a phase of the high-frequency wave charged into the high-frequency cavity to be matched with the electron beam. For this adjustment, it was necessary to use a dedicated mechanism such as a phase adjuster to adjust the phase.

Conventionally used high-frequency phase adjusting devices includes (1) phase adjusting devices which mechanically adjust a transmission distance and (2) phase adjusting devices which adjust an insertion length of a conductor or a low-loss dielectric into a waveguide to change a in-tube wavelength in the waveguide, thereby adjusting a phase.

The phase adjusting device of (2), which changes a in-tube wavelength, can equivalently adjust a line length by changing an effective speed of a high-frequency wave in a waveguide.

However, when a high-frequency wave of high power is transmitted, it is necessary to maintain the inside of the waveguide in a high-vacuum state and increase a sparkover voltage in the waveguide in order to prevent electric discharge. Accordingly, from the viewpoint of suppression of electric discharge, it is very difficult to insert a conductor or a low-loss dielectric for changing the in-tube wavelength as described above into the waveguide with a strong electric field. In addition, a gas may discharges from the low-loss dielectric, and thus there are problems in that the vacuum deteriorates and electric discharge occurs.

Accordingly, particularly, a phase adjuster of a high-frequency band equal to or more than an X-band has not been developed.

The invention is contrived to solve the problems. That is, an object of the invention is to provide a charged particle beam decelerating device and method which can efficiently decelerate a charged particle beam of high energy of 10 MeV or more up to less than 1 MeV without using a phase adjuster of a high-frequency band, thereby not requiring large-scale shielding and achieving miniaturization of the system and cost reduction, and an X-ray generating apparatus using the device and method.

DISCLOSURE OF THE INVENTION

Means for Solving the Problems

According to the invention, there is provided a charged particle beam decelerating device including: a high-frequency cavity provided on an orbit of a charged particle beam; and a phase synchronizing device for synchronizing the charged particle beam in the high-frequency cavity with a phase of a high-frequency electric field.

According to a preferred embodiment of the invention, the phase synchronizing device is a decelerating tube moving device for moving the high-frequency cavity along the orbit of the charged particle beam.

According to another preferred embodiment, the phase synchronizing device is a deflecting magnet moving device for moving a deflecting magnet deflecting the orbit of the charged particle beam.

According to further another preferred embodiment, the phase synchronizing device is a deflecting magnet control device for controlling a magnetic flux density of a deflecting magnet deflecting the orbit of the charged particle beam.

According to still further another preferred embodiment, the phase synchronizing device is an $\alpha$-magnet control device for controlling a magnetic flux density of an $\alpha$-magnet changing the orbit of the charged particle beam with a magnetic field.

The high-frequency cavity is a decelerating tube provided on the downstream side of an accelerating tube for accelerating the charged particle beam.

According to a preferred embodiment of the invention, a high-frequency transmission path for transmitting a high-frequency wave to the upstream side of the decelerating tube from the downstream side of the accelerating tube is provided.

According to another preferred embodiment, the high-frequency cavity is composed of a plurality of decelerating tubes arranged in series, and the downstream side of the upstream-side decelerating tube is connected to the upstream side of the adjacent downstream-side decelerating tube by the high-frequency transmission path.

According to further another preferred embodiment, a high-frequency circulation path for transmitting a high-frequency wave to the upstream side from the downstream side of the high-frequency cavity is provided.

According to the invention, there is provided an X-ray generating apparatus including the above-described charged particle beam decelerating device.

According to the invention, there is provided a charged particle beam decelerating method including: providing a high-frequency cavity on an orbit of a high-energy charged particle beam; and synchronizing the charged particle beam in the high-frequency cavity with a phase of a high-frequency electric field by moving the high-frequency cavity or changing an orbit length of the charged particle beam.

ADVANTAGES OF THE INVENTION

According to the above-described device and method of the invention, since a phase of a high-frequency electric field in a high-frequency cavity is synchronized with a charged particle beam by moving the high-frequency cavity or changing an orbit length of the charged particle beam by a phase synchronizing device, the charged particle beam collided with a laser beam can be matched with a phase of a charged high-frequency wave, and beam energy can be adjusted without actively adjusting the phase of the high-frequency wave by using a dedicated adjuster or the like.

Moreover, since energy of the decelerated charged particle beam is converted into energy of the high-frequency wave, it can be discarded or reused.

Accordingly, by the invention, beam energy can be decelerated without adjusting the phase of the high-frequency wave, large-scale shielding and the like for preventing intense radiation (X-ray, neutron and $\gamma$-ray) from leaking to the outside is simplified, and the system is miniaturized.

DESCRIPTION OF THE PREFERRED EMBODIMENTS

Figure 1:
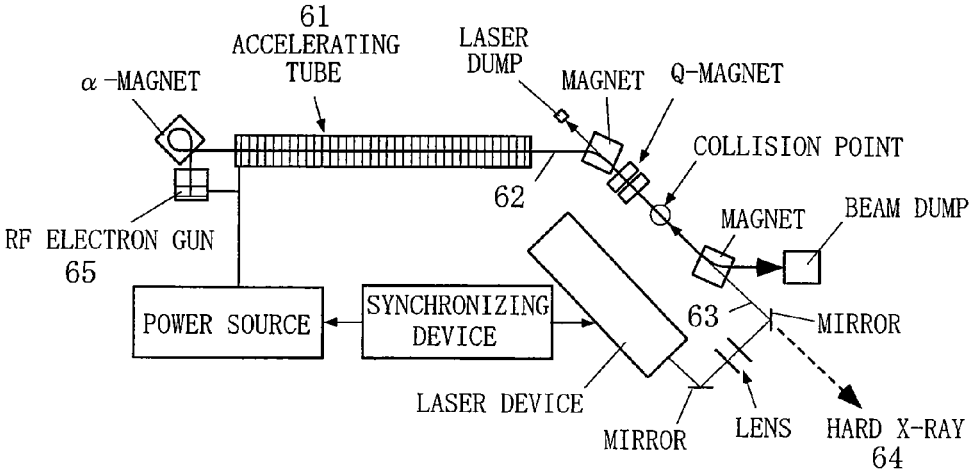
FIG. 1 PRIOR ART
FIG. 1 is a diagram showing the configuration of a "small-sized X-ray generating apparatus" of Non-Patent Document 1.
Figure 2:
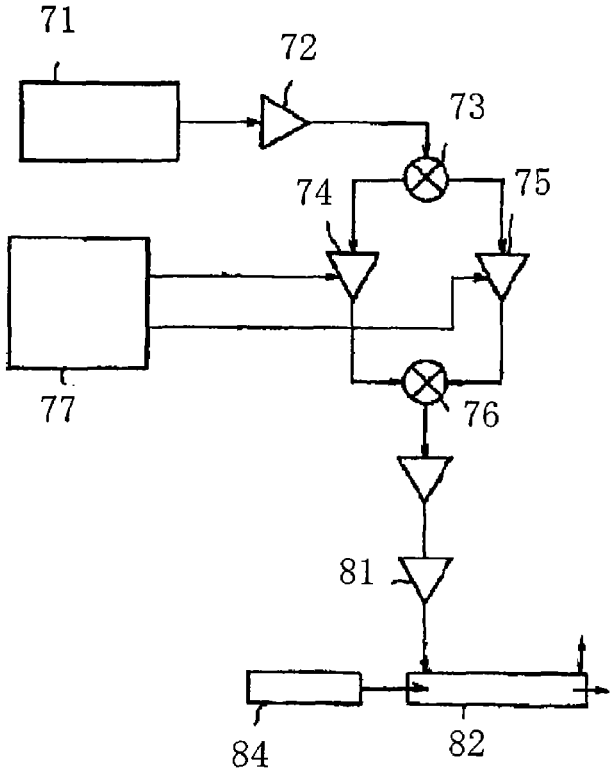
PRIOR ART FIG. 2
FIG. 2 is a diagram showing the configuration of an "electron beam accelerating device" of Patent Document 1.
Figure 3:
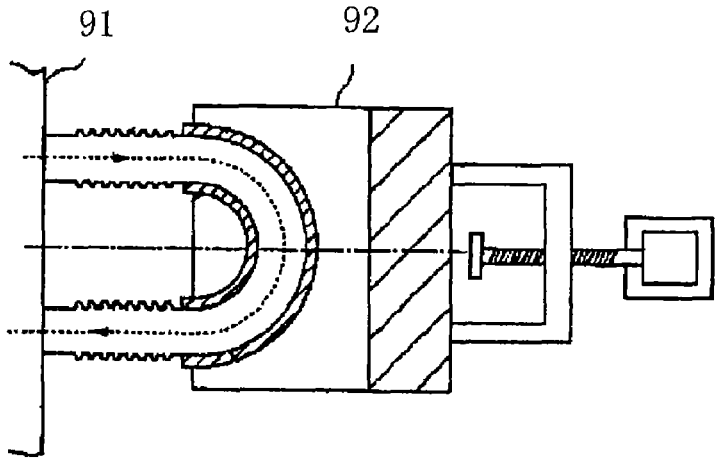
PRIOR ART FIG. 3
FIG. 3 is a diagram showing the configuration of an "electron beam device" of Patent Document 2.

Hereinafter, preferred embodiments of the invention will be described with reference to the drawings. It is to be noted that, in the drawings, a common part is denoted with the same reference numeral, and redundant description is omitted.

In the following example, a description will be given on the supposition that a charged particle beam is an electron beam.

Figure 4:
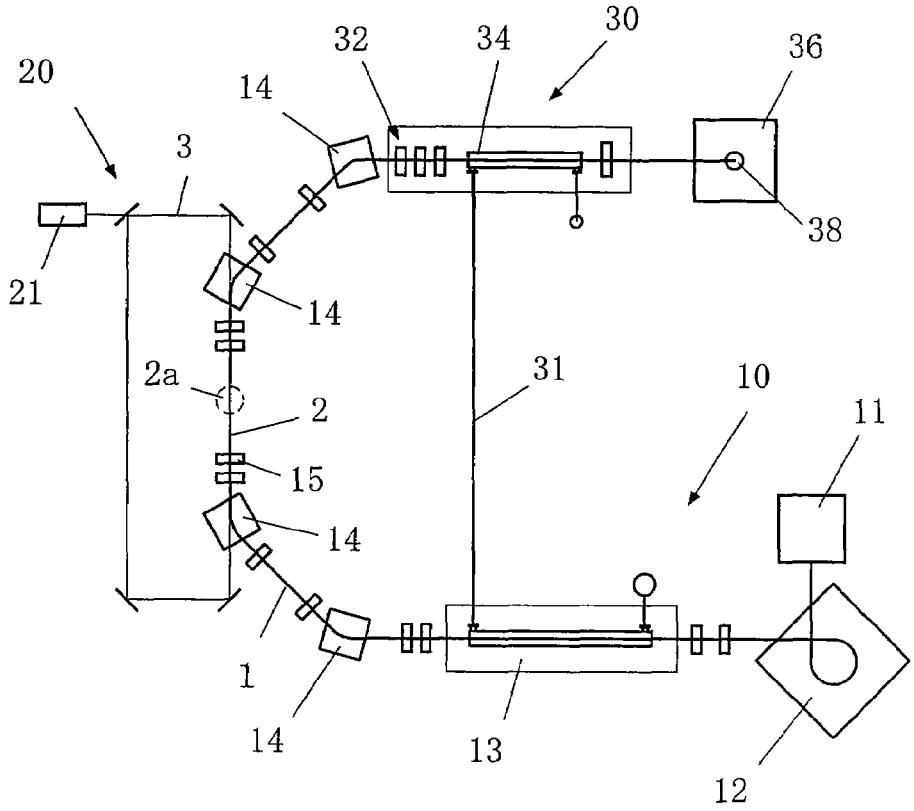
FIG. 4 is a diagram showing the whole configuration of an X-ray generating apparatus including a charged particle beam decelerating device according to the invention.

FIG. 4 is a diagram showing the whole configuration of an X-ray generating apparatus including a charged particle beam decelerating device according to the invention. The X-ray generating apparatus is an inverse Compton scattering X-ray generating apparatus including an electron beam generating device 10, a laser generating device 20 and a charged particle beam decelerating device 30.

The electron beam generating device 10 has a function of accelerating an electron beam to generate a pulse charged particle beam 1 and transmitting the beam through a predetermined rectilinear orbit 2.

In this example, the electron beam generating device 10 includes an RF electron gun 11, an α-magnet 12, an accelerating tube 13, deflecting magnets 14 and Q-magnets (four-pole electromagnet) 15.

The RF electron gun 11 and the accelerating tube 13 are driven by a high-frequency power source (not shown) of an X-band (11.424 GHz). An orbit of the electron beam 1 drawn from the RF electron gun 11 is changed by the α-magnet 12. The beam then enters the accelerating tube 13. The accelerating tube 13 is a small-sized X-band accelerating tube which accelerates the electron beam to generate a high-energy electron beam of, for example, about 50 MeV.

This electron beam is the pulse electron beam 1 of, for example, about 1 μs.

The deflecting magnet 14 bends the orbit of the pulse electron beam 1 with a magnetic field, transmits the beam through the predetermined rectilinear orbit 2, and then guides the pulse charged particle beam 1 to the charged particle beam decelerating device 30. A convergence degree of the pulse electron beam 1 is adjusted by the Q-magnet 15.

By the electron beam generating device 10 described above, the pulse electron beam 1 of, for example, about 50 MeV and about 1 μs can be generated and transmitted through the predetermined rectilinear orbit 2.

The laser generating device 20 has a laser device 21 and generates a predetermined pulse laser beam 3 to bring the pulse laser beam and the electron beam 1 into frontal collision on the predetermined rectilinear orbit 2.

With the above-described configuration, the accelerated pulse electron beam 1 is allowed to collide with the pulse laser beam 3, and thus an intense X-ray can be generated from a collision point 2*a* by inverse Compton scattering.

Figure 5:
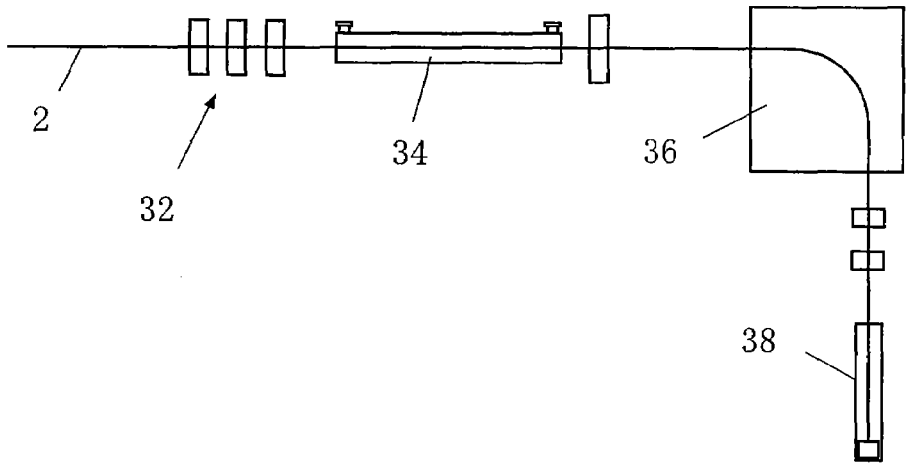
FIG. 5 is a side view of the charged particle beam decelerating device of FIG. 4.

FIG. 5 is a side view of the charged particle beam decelerating device 30 of FIG. 4.

As shown in FIGS. 4 and 5, the charged particle beam decelerating device 30 includes a beam orbit adjusting electromagnet 32, a decelerating cavity 34, a beam energy confirming mechanism 36 and a beam discarding mechanism 38.

The beam orbit adjusting electromagnet 32 adjusts the orbit of the pulse electron beam 1 transmitted through the rectilinear orbit 2. The decelerating cavity 34 is a high-frequency cavity provided on the orbit of the high-energy electron beam 1. The decelerating cavity 34 is an X-band decelerating tube in this example.

As the high-frequency cavity, there is a linear accelerator, a circular cavity resonator such as a synchrotron, or a traveling wave-type decelerating tube.

The beam energy confirming mechanism 36 deflects the orbit of the electron beam 1 transmitted through the decelerating cavity 34, downward in this example, and detects the energy thereof. The beam discarding mechanism 38 allows the electron beam 1 to collide with an energy absorbing material (for example, graphite) to consume the energy as, for example, thermal energy.

The charged particle beam decelerating device 30 according to the invention includes the high-frequency cavity 34 provided on the orbit of the high-energy electron beam 1, and a phase synchronizing device (to be described later) for synchronizing the electron beam 1 in the high-frequency cavity 34 with a phase of a high-frequency electric field.

The high-frequency cavity 34 is the above-described decelerating cavity 34. In this example, the high-frequency cavity 34 is a decelerating tube provided on the downstream side of the accelerating tube 13 for accelerating the electron beam 1.

The charged particle beam decelerating device 30 according to the invention includes a high-frequency transmission path 31 for transmitting a high-frequency wave 4 to the upstream side of the decelerating tube 34 from the downstream side of the accelerating tube 13. With the above configuration, the high-frequency wave of the accelerating tube 13 can be reused, and a high-frequency source for the whole system can be miniaturized.

Figure 6A:
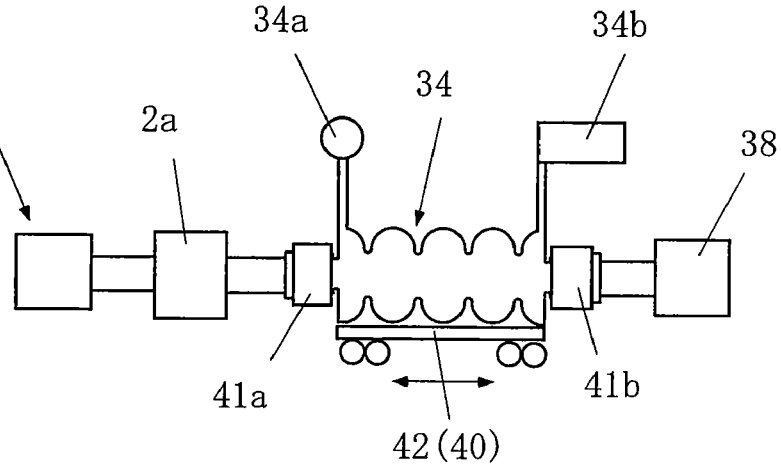
FIG. 6A is a diagram showing a first embodiment of the charged particle beam decelerating device according to the invention.

FIG. 6A is a diagram showing a first embodiment of the charged particle beam decelerating device 30 according to the invention. In this drawing, a phase synchronizing device 40 is a decelerating tube moving device 42 for moving the high-frequency cavity 34 along the orbit of the electron beam 1.

A high-frequency electric field is transmitted from a high-frequency source 34*a* to the upstream side of the high-frequency cavity 34 to be transmitted to the downstream side in the high-frequency cavity 34, and be discharged to a high-frequency dump 34*b* from the downstream side.

Expandable bellows 41*a* and 41*b* are provided at the upstream end and the downstream end of the high-frequency cavity 34, respectively, to move the high-frequency cavity 34 along the orbit of the electron beam 1 while keeping the inside of the high-frequency cavity 34 in a vacuum state.

The decelerating tube moving device 42 is, for example, a spiral screw, a rack and pinion, and a linear actuator. The decelerating tube moving device 42 can continuously move the high-frequency cavity 34 along the orbit of the electron beam 1, and can fix the high-frequency cavity 34 at an arbitrary position.

Figure 6B:
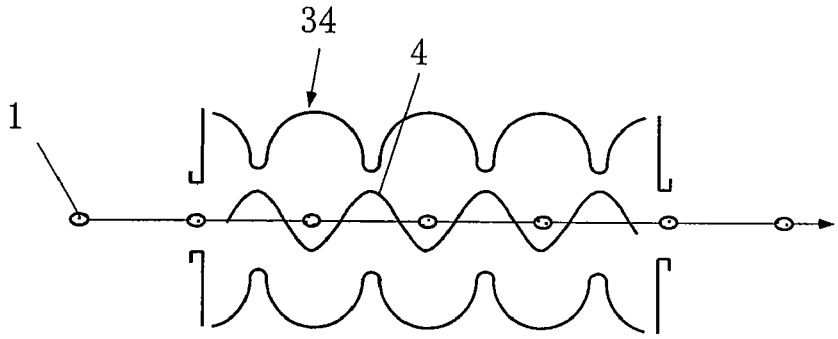
FIG. 6B is a schematic diagram of FIG. 6A.
Figure 6C:
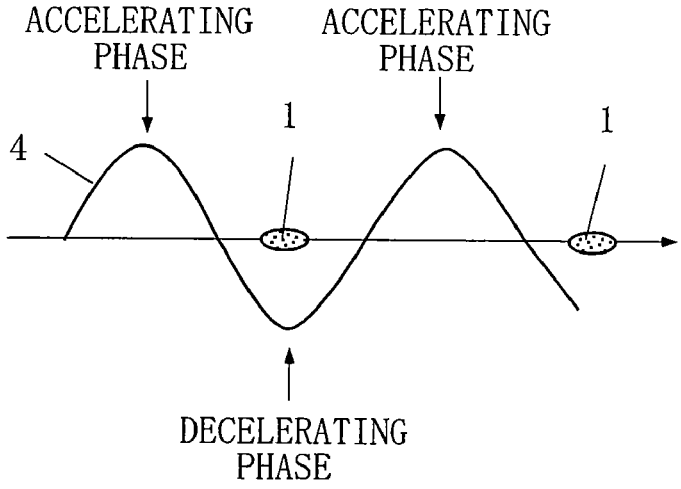
FIG. 6C is a diagram showing the principle of FIG. 6A.

FIG. 6B is a diagram schematically showing a relationship between the electron beam 1 and the high-frequency electric field 4 in the high-frequency cavity 34, and FIG. 6C is a diagram showing the principle.

A in-tube wavelength of the high-frequency electric field 4 in the high-frequency cavity 34 is about 32 mm when an X-band (11.424 GHz) is used for the high-frequency. A progression rate of the high-frequency electric field 4 is almost the same as the speed of light.

A speed of the electron beam 1 accelerated to the energy of 10 MeV or more is also almost the same as the speed of light.

Accordingly, ½ of the wavelength of the high-frequency electric field 4 is a decelerating phase, and as shown in FIG. 6C, the electron beam 1 can be efficiently decelerated by synchronizing the electron beam 1 with the decelerating phase of the high-frequency electric field 4.

The decelerating tube moving device 42 of FIG. 6A can continuously move the high-frequency cavity 34 along the orbit of the electron beam 1 by a length equal to or longer than a length corresponding to the in-tube wavelength (for example, about 32 mm) of the high-frequency electric field 4, and can fix the high-frequency cavity 34 at an arbitrary position. Accordingly, even when the phase of the high-frequency electric field 4 in the high-frequency cavity 34 is positioned at any position, the electron beam 1 can be synchronized with the phase of the high-frequency electric field 4 only by moving the high-frequency cavity 34.

Synchronization of the electron beam 1 with the phase of the high-frequency electric field 4 is set so that the energy detected by the above-described beam energy confirming mechanism 36 becomes minimum.

Figure 7:
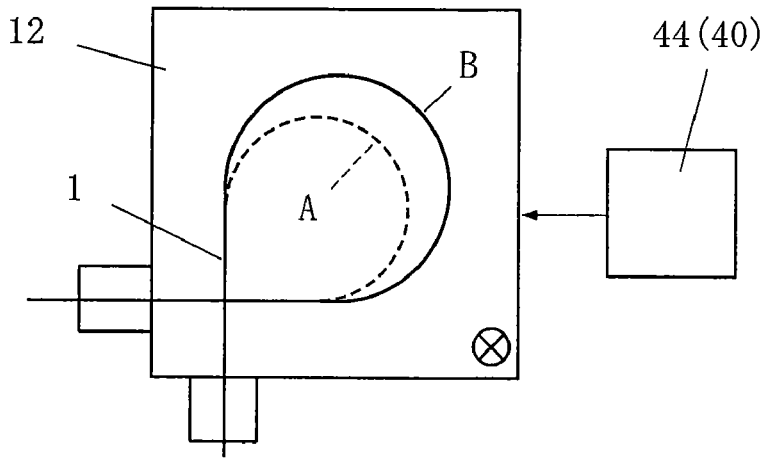
FIG. 7 is a diagram showing a second embodiment of the charged particle beam decelerating device according to the invention.

FIG. 7 is a diagram showing a second embodiment of the charged particle beam decelerating device 30 according to the invention. In this drawing, the phase synchronizing device 40 is an α-magnet control device 44 for controlling a magnetic flux density B of the above-described α-magnet 12 changing the orbit of the electron beam 1 with a magnetic field.

When E denotes energy of the beam, the electron beam 1 in a constant magnetic field B draws a circular orbit due to a relational expression (1), that is, $E[GeV]=0.3\times B\times R$, where R denotes radius of curvature.

For example, electron beam energy E is 50 MeV=0.05 GeV and the magnetic flux density B is 0.4 T, the radius of curvature is 0.417 m.

When the orbit length of beam orbit A, B is changed by the α-magnet 12 by 32 mm (length corresponding to the in-tube wavelength of the high-frequency electric field 4), it is preferable that a difference in radius of curvature is about 6.8 mm. When the radius of curvature of the beam orbit A is 150 mm, it is preferable that the magnetic flux density is 1.11 T, and when a radius of the beam orbit B is 156.8 mm, it is preferable that the magnetic flux density is 1.06 T.

That is, when the magnetic flux density B of the α-magnet 12 is weakened by the α-magnet control device 44, change from the beam orbit A to the beam orbit B is caused, and thus a beam orbit length is changed. At the magnetic flux density in the middle thereof, the electron beam 1 can be synchronized with the phase of the high-frequency electric field 4, and the electron beam 1 can be thus efficiently decelerated.

Figure 8:
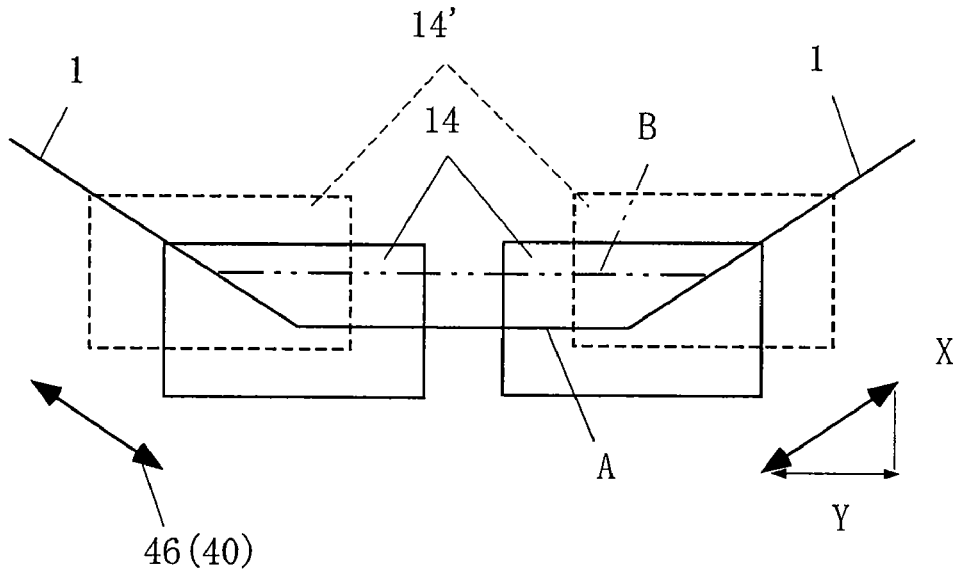
FIG. 8 is a diagram showing a third embodiment of the charged particle beam decelerating device according to the invention.

FIG. 8 is a diagram showing a third embodiments of the charged particle beam decelerating device 30 according to the invention. In this drawing, the phase synchronizing device 40 is a deflecting magnet moving device 46 for moving the deflecting magnet 14 deflecting the orbit of the electron beam 1.

Expandable bellows are provided respectively at the upstream end and the downstream end of a hollow tube (not shown) configuring the orbit of the electron beam 1, to move the deflecting magnet 14 along an orbit direction (X direction) of the electron beam 1 while keeping the inside of the hollow tube in a vacuum state.

The deflecting magnet moving device 46 is, for example, a spiral screw, a rack and pinion, and a linear actuator. The deflecting magnet moving device 46 can continuously move the deflecting magnet 14 along the orbit of the electron beam 1, and can fix the deflecting magnet moving device 46 at an arbitrary position.

With this configuration, when two deflecting magnets 14 are moved in the moving direction X, the bellows are expanded and contracted, change from the beam orbit A to the beam orbit B is caused, and the orbit length is changed by two times a difference between X and a Y direction component of X.

In order to change the orbit length by 32 mm (length corresponding to the in-tube wavelength of the high-frequency electric field 4), it is preferable that the respective magnets are moved by about 55 mm in the X direction because it is preferable a difference between X and Y is 16 mm when the magnets are disposed to be tilted by 45 degrees.

That is, when the deflecting magnets 14 are moved by the deflecting magnet moving device 46, a length of the orbit of the electron beam 1 is changed. At the intermediate position thereof, the electron beam 1 can be synchronized with the phase of the high-frequency electric field 4, and thus the electron beam 1 can be efficiently decelerated.

The arrangement and the moving direction of the deflecting magnet 14 can be freely set as long as the orbit length of the electron beam 1 can be changed.

Figure 9:
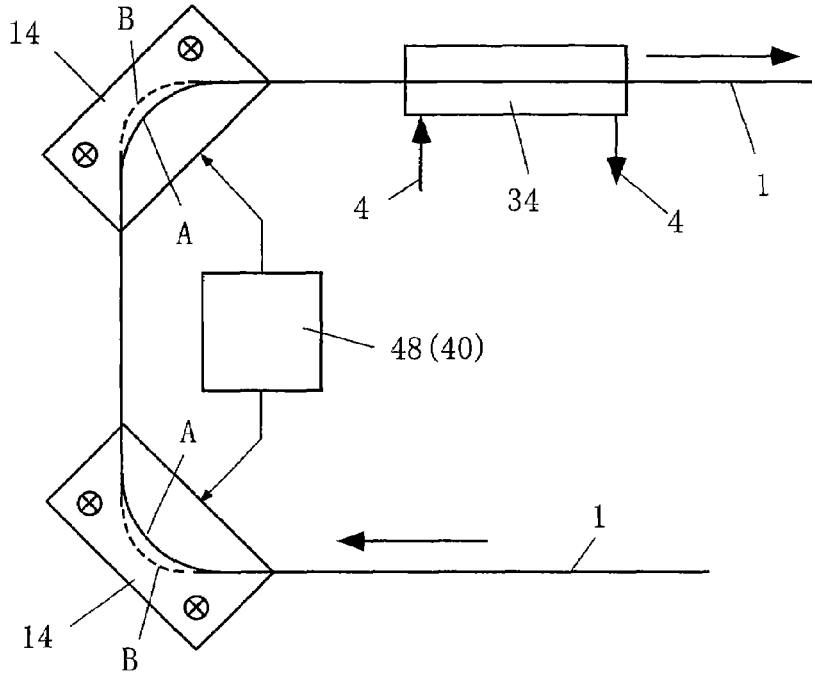
FIG. 9 is a diagram showing a fourth embodiment of the charged particle beam decelerating device according to the invention.

FIG. 9 is a diagram showing a fourth embodiment of the charged particle beam decelerating device 30 according to the invention. In this drawing, the phase synchronizing device 40 is a deflecting magnet control device 48 for controlling the magnetic flux density of the deflecting magnet 14 deflecting the orbit of the electron beam 1.

When the magnetic flux density of the deflecting magnet 14 is weakened, change from the beam orbit A to the beam orbit B is caused, and the beam orbit length is changed by an amount corresponding to the change. By adjusting the beam orbit length, time when the electron beam 1 reaches the high-frequency cavity can be adjusted and beam energy can be arbitrarily adjusted.

Figure 10A:
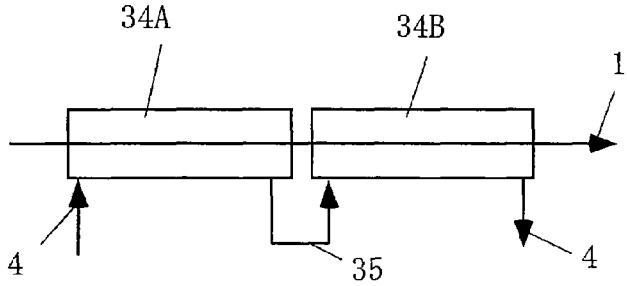
FIG. 10A is a diagram showing a fifth embodiment of the charged particle beam decelerating device according to the invention.

FIG. 10A is a diagram showing a fifth embodiment of the charged particle beam decelerating device 30 according to the invention. In this drawing, the high-frequency cavity 34 is composed of plural (in this example, two) decelerating tubes 34A and 34B arranged in series, and the downstream side of the upstream-side decelerating tube 34A and the upstream side of the adjacent downstream-side decelerating tube 34B are connected to each other by a high-frequency transmission path 35.

With this configuration, the high-frequency electric field 4 with the energy increased by decelerating the electron beam 1 in the upstream-side decelerating tube 34A can be transmitted to the downstream-side decelerating tube 34B by the high-frequency transmission path 35 to be reused, and necessary energy for the high-frequency cavity 34 can be reduced.

Figure 10B:
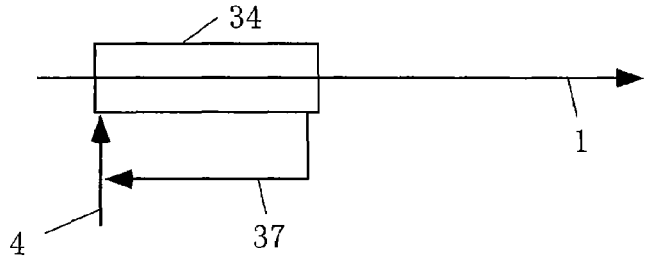
FIG. 10B is a diagram showing a sixth embodiment of the charged particle beam decelerating device according to the invention.

FIG. 10B is a diagram showing a sixth embodiment of the charged particle beam decelerating device 30 according to the invention. In this drawing, a high-frequency circulation path 37 for transmitting a high-frequency wave to the upstream side from the downstream side of the high-frequency cavity 34 is provided.

With this configuration, the high-frequency electric field 4 with the energy increased by decelerating the electron beam 1 in the high-frequency cavity 34 can be transmitted to the upstream side of the high-frequency cavity 34 by the high-frequency circulation path 37 to be reused, and necessary energy for the high-frequency cavity 34 can be reduced.

In addition, according to the method of the invention, the high-frequency cavity 34 is provided on the orbit of the high-energy charged particle beam 1, and the charged particle beam 1 in the high-frequency cavity 34 is synchronized with the phase of the high-frequency electric field 4 by moving the high-frequency cavity 34 or changing the orbit length of the charged particle beam 1.

According to the above-described device and method of the invention, since the charged particle beam 1 in the high-frequency cavity 34 is synchronized with the phase of the high-frequency electric field 4 by moving the high-frequency cavity 34 or changing the orbit length of the charged particle beam 1 by the phase synchronizing device 30, the charged particle beam 1 collided with the laser beam 3 can be matched with the phase of the charged high-frequency wave, and beam energy can be adjusted without actively adjusting the phase of the high-frequency wave by using a dedicated adjuster or the like.

Since the energy of the decelerated electron beam 1 is converted into the energy of the high-frequency wave 4, it can be discarded or reused.

Accordingly, by the invention, beam energy can be decelerated without adjusting the phase of the high-frequency wave, large-scale shielding and the like for preventing intense radiation (X-ray, neutron and γ-ray) from leaking to the outside is simplified, and the system is miniaturized.

It is to be understood that the invention is not limited to the above-described embodiments and that various changes and modifications can be made without departing from the gist of the invention.

In addition, the invention is not limited to the X-band. The invention can be applied to not only an S-band and a C-band of which wavelengths are longer than a wavelength of the X-band, but also a Ku-band and a K-band of which wavelengths are short, for cost reduction in terms of unnecessity of a phase adjusting function.

The invention claimed is:

1. A charged particle beam decelerating device comprising:

a high-frequency cavity provided on an orbit of a charged particle beam; and a phase synchronizing device for synchronizing the charged particle beam in the high-frequency cavity with a phase of a high-frequency electric field.

2. The charged particle beam decelerating device according to claim 1, wherein the phase synchronizing device is a decelerating tube moving device for moving the high-frequency cavity along the orbit of the charged particle beam.

3. An X-ray generating apparatus comprising:

the charged particle beam decelerating device according to claim 2.

4. The charged particle beam decelerating device according to claim 2, wherein the high-frequency cavity is a decelerating tube disposed on the downstream side of an accelerating tube for accelerating the charged particle beam, and a high-frequency transmission path for transmitting a high-frequency wave to the upstream side of the decelerating tube from the downstream side of the accelerating tube is provided.

5. The charged particle beam decelerating device according to claim 2, wherein the high-frequency cavity is composed of a plurality of decelerating tubes arranged in series, and the downstream side of the upstream-side decelerating tube is connected to the upstream side of the adjacent downstream-side decelerating tube by a high-frequency transmission path.

6. The charged particle beam decelerating device according to claim 2, further comprising a high-frequency circulation path for transmitting a high-frequency wave to the upstream side from the downstream side of the high-frequency cavity.

7. The charged particle beam decelerating device according to claim 1, wherein the high-frequency cavity is a decelerating tube disposed on the downstream side of an accelerating tube for accelerating the charged particle beam, and a high-frequency transmission path for transmitting a high-frequency wave to the upstream side of the decelerating tube from the downstream side of the accelerating tube is provided.

8. An X-ray generating apparatus comprising:

the charged particle beam decelerating device according to claim 7.

9. The charged particle beam decelerating device according to claim 1, wherein the high-frequency cavity is composed of a plurality of decelerating tubes arranged in series, and the downstream side of the upstream-side decelerating tube is connected to the upstream side of the adjacent downstream-side decelerating tube by a high-frequency transmission path.

10. An X-ray generating apparatus comprising:

the charged particle beam decelerating device according to claim 9.

11. The charged particle beam decelerating device according to claim 1, further comprising a high-frequency circulation path for transmitting a high-frequency wave to the upstream side from the downstream side of the high-frequency cavity.

12. An X-ray generating apparatus comprising:

the charged particle beam decelerating device according to claim 11.

13. An X-ray generating apparatus comprising:

the charged particle beam decelerating device according to claim 1.

14. A charged particle beam decelerating method comprising:

providing a high-frequency cavity on an orbit of a high-energy charged particle beam; and synchronizing the charged particle beam in the high-frequency cavity with a phase of a high-frequency electric field by moving the high-frequency cavity.

15. The charged particle beam decelerating method according to claim 14, wherein by a high-frequency transmission path, a high-frequency wave transmitted from the downstream side of an accelerating tube to the upstream side of the high-frequency cavity to be used.

16. The charged particle beam decelerating method according to claim 14, wherein the high-frequency cavity is composed of a plurality of decelerating tubes arranged in series, and a high-frequency wave is transmitted for use by a high-frequency transmission path connecting the downstream side of the upstream-side decelerating tube to the upstream side of the adjacent downstream-side decelerating tube.

17. The charged particle beam decelerating method according to claim 14, wherein a high-frequency wave is transmitted for use by a high-frequency circulation path transmitting the high-frequency wave to the upstream side from the downstream side of the high-frequency cavity.

* * * * *